US009664003B2

(12) United States Patent
Nott et al.

(10) Patent No.: US 9,664,003 B2
(45) Date of Patent: May 30, 2017

(54) NON-STOP DRILLER MANIFOLD AND METHODS

(71) Applicant: Canrig Drilling Technology Ltd., Houston, TX (US)

(72) Inventors: Darcy Stephen Nott, The Woodlands, TX (US); Mark Blankenship, Tomball, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 654 days.

(21) Appl. No.: 13/966,837

(22) Filed: Aug. 14, 2013

(65) Prior Publication Data

US 2015/0047834 A1 Feb. 19, 2015

(51) Int. Cl.
*E21B 21/08* (2006.01)
*E21B 21/10* (2006.01)

(52) U.S. Cl.
CPC ..... *E21B 21/08* (2013.01); *E21B 21/106* (2013.01)

(58) Field of Classification Search
None
See application file for complete search history.

(56) References Cited

U.S. PATENT DOCUMENTS 1,491,986 A 4/1924 Greene
2,102,555 A 12/1937 Dyer
2,158,356 A 5/1939 Dyer
3,298,385 A 1/1967 Jackson et al.
6,276,458 B1 8/2001 Malone et al.
6,315,051 B1 11/2001 Ayling
6,328,112 B1 12/2001 Malone
6,374,925 B1 4/2002 Elkins et al.
6,527,062 B2 3/2003 Elkins et al.
6,739,397 B2 5/2004 Ayling
6,814,142 B2 11/2004 Paulk et al.
6,920,942 B2 7/2005 Koederitz
7,028,586 B2 4/2006 Robichaux
7,044,237 B2 5/2006 Leuchtenberg
7,252,151 B2 8/2007 Ayling
7,278,496 B2 10/2007 Leuchtenberg
7,308,952 B2 12/2007 Strazhgorodskiy
7,350,597 B2 4/2008 Reitsma et al.
7,367,411 B2 5/2008 Leuchtenberg
7,407,019 B2 8/2008 Kinder et al.
7,562,723 B2 7/2009 Reitsma
7,650,950 B2 1/2010 Leuchtenberg
(Continued)

OTHER PUBLICATIONS

WIPO, PCT/US2014/047896, "International Search Report," Nov. 7, 2014, 5 pages.

(Continued)

*Primary Examiner* — Caroline Butcher
(74) *Attorney, Agent, or Firm* — Haynes and Boone, LLP

(57) ABSTRACT

Apparatus, systems, and methods for continuously circulating drilling fluid through a tubular string are described. The methods include connecting a sub having a central bore and a side bore to the tubular string, connecting a top drive to the tubular string, connecting a manifold to the sub and top drive, wherein the manifold comprises a plurality of electrically controlled valves, and controlling the flow of drilling fluid through the sub and top drive by selectively opening and closing the electrically controlled valves.

31 Claims, 2 Drawing Sheets

(56) References Cited

U.S. PATENT DOCUMENTS

| | | | | |
|---|---|---|---|---|
| 7,726,418 | B2 | 6/2010 | Ayling | |
| 7,828,081 | B2 | 11/2010 | Reitsma | |
| 7,836,973 | B2 | 11/2010 | Belcher et al. | |
| 7,845,433 | B2 | 12/2010 | Calderoni et al. | |
| 8,016,033 | B2 | 9/2011 | Iblings et al. | |
| 8,100,199 | B2 | 1/2012 | Braddick | |
| 8,210,266 | B2 | 7/2012 | Younger et al. | |
| 8,360,170 | B2 | 1/2013 | Leuchtenberg | |
| 8,490,719 | B2 | 7/2013 | Duhe et al. | |
| 8,505,635 | B2 | 8/2013 | Vatne | |
| 8,590,640 | B2 | 11/2013 | Haughom | |
| 8,627,890 | B2 | 1/2014 | Bailey et al. | |
| 8,657,034 | B2 | 2/2014 | Leuchtenberg | |
| 8,955,619 | B2 | 2/2015 | Tilton et al. | |
| 9,051,803 | B2 | 6/2015 | Leuchtenberg | |
| 2002/0074127 | A1* | 6/2002 | Birckhead | E21B 43/121 166/372 |
| 2005/0263279 | A1 | 12/2005 | Vachon | |
| 2006/0207795 | A1* | 9/2006 | Kinder | E21B 21/08 175/38 |
| 2007/0246263 | A1 | 10/2007 | Reitsma | |
| 2009/0025930 | A1* | 1/2009 | Iblings | E21B 19/16 166/244.1 |
| 2010/0155143 | A1 | 6/2010 | Braddick | |
| 2012/0090853 | A1 | 4/2012 | Leuchtenberg et al. | |
| 2013/0087733 | A1* | 4/2013 | Rolland | E21B 21/106 251/326 |
| 2013/0118806 | A1* | 5/2013 | Hannegan | E21B 19/09 175/5 |
| 2013/0299240 | A1 | 11/2013 | Leuchtenberg | |
| 2014/0090888 | A1* | 4/2014 | Smith | E21B 21/106 175/38 |

OTHER PUBLICATIONS

WIPO, PCT/US2014/047896, Written Opinion of the International Searching Authority, Nov. 7, 2014, 10 pages.

Frink, Philip, et al., "A Case Study: Drilling Underbalanced in Mobil Indonesia's Arun Field," Presentation at IADC Underbalanced Drilling Conference & Exhibition, 1999.

Quitzau, R., et al., "SPE/ADC 52808: System for Drilling an Offishore Shallow Sour Gas Carbonate Reservoir," 10 pgs., 1999.

* cited by examiner

NON-STOP DRILLER MANIFOLD AND METHODS

TECHNICAL FIELD

The present disclosure relates to an apparatus, systems, and methods for drilling in which tubulars can be added or removed from a drill string while drilling fluid is circulating.

BACKGROUND OF THE DISCLOSURE

In many drilling operations to recover hydrocarbons, a drill string made by assembling pieces or joints of drill tubulars or pipe with threaded connections and having a drill bit at the bottom is rotated to move the drill bit. The entire drill string may be rotated using a rotary table, or using an over-ground drilling motor mounted on top of the drill string, typically known as a "top-drive." As drilling progresses, a flow of drilling fluid, e.g., mud, is used to carry the debris created by the drilling process out of the borehole. Mud is pumped down the drill string to pass through the drill bit, and returns to the surface via the annular space between the outer diameter of the drill string and the borehole (generally referred to as the annulus). The mud flow also serves to cool the drill bit, and to pressurize the borehole, thus substantially preventing inflow of fluids from formations penetrated by the drill string from entering into the borehole.

As the drill bit penetrates into the earth and the wellbore is lengthened, more joints of drill pipe are added to the drill string. This typically involves stopping the pumping while the tubulars are added. The process is reversed when the drill string is removed or tripped, e.g., to replace the drilling bit or to perform other wellbore operations, pumping must be halted to remove each tubular from the drill string. Interruption of pumping may mean that the circulation of the mud stops and has to be re-started when pumping resumes. This can be time consuming, can cause deleterious effects on the walls of the wellbore being drilled, and can lead to formation damage and problems in maintaining an open wellbore.

To overcome this problem, methods for continuous circulation of mud have been developed. Current continuous circulation systems and methods use manual and hydraulically actuated valves, which add to complexity, weight, and controls.

Thus, a need exists for an improved apparatus, system, and methods that provide continuous circulation while adding or removing tubulars from a drill string.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
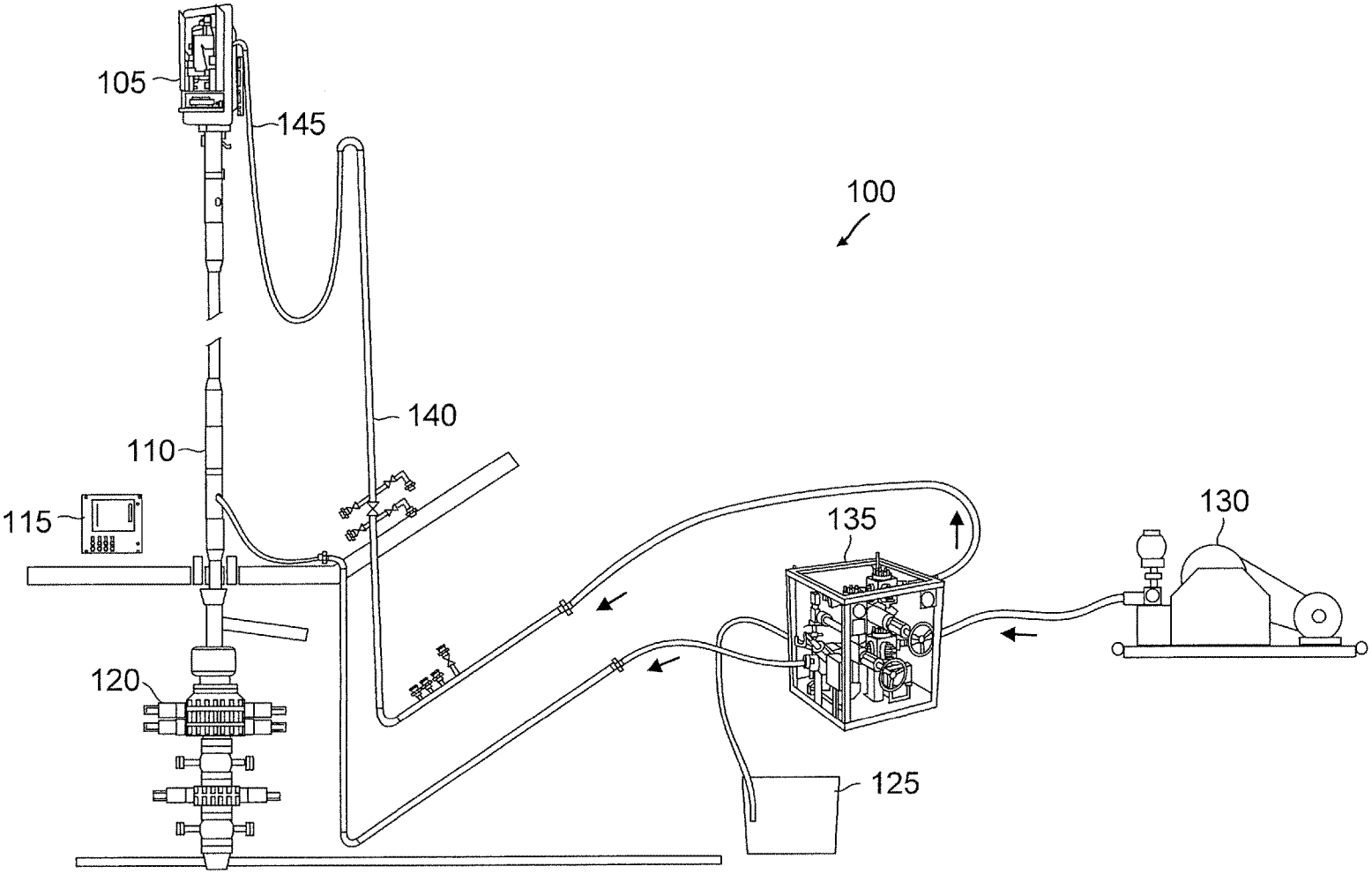
FIG. 1 is a diagram of a drilling rig with a manifold and control system according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure provides systems that use electrically operated actuators to work valves that control the flow of drilling fluid through a drill string. By "drilling fluid" is meant any fluid or fluid mixture used during drilling, including complex mixtures based on water, oil, or gas used to stabilize the borehole when drilling for oil, to transport solid material and cuttings to the surface, or the like, and any combination thereof. Drilling fluid is commonly referred to as mud and may include a proppant or various chemical materials to modify the properties of the mud, and the two terms are used interchangeably herein.

Electric components lower cost, complexity, and weight, and provide greater and improved control of valves. Certain electric actuators have built-in limit switches and programmable valve movement control features without the need for an external controller, although one may be used. The actuators also have the ability to provide interlocks with other valves, and the ability to receive remote signals to control open and close sequences of the valves operably associated with the actuator(s). The electronic actuators also tend to be smaller in height than hydraulic actuators. Moreover, consistent opening and closing positions of valves and timing can be obtained, and the valves can be monitored for failure and maintained. The actuators can provide data that can be used to monitor potential changes in system performance that may be a failure or maintenance requirement. The electric actuators can more precisely control opening and closing speeds, and positions of valves, to react based on input parameters and preset values. Moreover, electric actuators can receive a safety integrity level (SIL) rating, which indicates a more reliable valve. The problems that come with hydraulic power units, such as tangled hoses, fluid spills, and cold weather issues are reduced. Exemplary actuators may be obtained from Rotork®, Siemens, and other commercially available actuators.

Referring to FIG. 1, the drilling rig 100 illustrated includes: (1) a top drive 105, (2) a non-stop driller (NSD) sub 110, (3) a controller 115, (4) a blow out preventer (BOP) stack 120, (5) a mud tank 125, (6) a mud pump 130, (7) a manifold 135, (8) a rig standpipe 140, and (9) a kelly hose 145. The top drive 105 rotates and provides circulating mud to the drill string. The NSD sub 110 enables tubulars to be added to the drill string while there is continuous circulation of mud through the drill string. The NSD sub 110 includes a main or central bore, through which mud flows axially, and a side bore, through which mud flows generally radially. The NSD sub 110 is provided with a valve assembly that is operable to substantially, or entirely, prevents flow of mud along the central bore and to substantially, or entirely, prevent flow of fluid along the side bore as needed to manage the flow of mud throughout the drilling environment. In one embodiment, the valve assembly comprises two separate valve members—a first valve member that is movable between an open position, in which flow of fluid along the central bore is permitted, and a closed position, in which flow of fluid along the central bore is substantially prevented, and a second valve member that is movable between an open position, in which flow of fluid along the side bore is permitted, and a closed position, in which flow of fluid along the side bore is substantially prevented. The first and second valve members can be a ball, plug, or other suitable valve available to those of ordinary skill in the art, and actuation of the valves can be by a mechanical, hydraulic or electrical mechanism or any other suitable mechanism, and can be a rotational, reciprocating or translation motion.

In an exemplary embodiment, the NSD sub 110 includes a Kelly-type ball valve and a side entry valve housed in the sub. Full rig pump circulation is continuously maintained throughout the drill pipe connection operation by circulating fluid into the side entry valve when a further tubular is being connected. During addition or removal of a section of drill pipe, the ball valve is closed. Pressure is bled off above the ball valve, allowing the drill pipe connection to the top drive to be broken while full circulation continues via the side entry valve. The rig pumps are thus never stopped, and in some embodiments are never slowed down except as the needs of pressure balancing the mud flow throughout the drilling environment might require, such that continuous circulation of drilling fluid can be achieved with the NSD sub 110.

The side entry valve can be intercepted from outside by means of a suitable adaptor (for example a rapid connector) that is coupled with a pipe. In some embodiments, the pipe is flexible. The pipe, referred to herein as a flexible pipe, in turn, is attached to a standpipe, which interconnects the NSD sub 110 to the manifold 135. The manifold 135 acts as the well pumping system of the drilling rig, and intercepts the flow of mud from mud pump 130 to the top drive 105 and the NSD sub 110. A rig standpipe 140 and kelly hose 145 connect the manifold 135 to the top drive 105.

The controller 115 may be configured to control or assist in the control of one or more components of the drilling rig 100 to manage the fluid flow. For example, the controller 115 may be configured to transmit operational control signals to the top drive 105, the NSD sub 110, the manifold 135 and/or the mud pump 130. The controller 115 may be a stand-alone component installed near the drilling rig 100, for example, on the manifold 135. In an exemplary embodiment, the controller 115 includes one or more systems located in a control room proximate the drilling rig 100, such as a general purpose shelter (often referred to as the "doghouse") serving as a combination tool shed, office, communications center and general meeting place. The controller 115 may be configured to transmit the operational control signals to the top drive 105, the NSD sub 110, the manifold 135 and/or the mud pump 130 via wired or wireless transmission means including to a location remote from the drilling rig 100 which, for the sake of clarity, are not depicted in FIG. 1.

The controller 115 is also configured to receive electronic signals via wired or wireless transmission means (also not shown in FIG. 1) from a variety of sensors included in the drilling rig 100, where each sensor is configured to detect an operational characteristic or parameter. Such sensors include fluid pressure, valve position, and flow sensors. The controller 115 may include one or more various types of controllers, such as a programmable logic controller (PLC).

In one embodiment, the controller 115 is operably connected to manifold 135. The controller 115 may at least partially automatically coordinate and control the flow of drilling fluid by adjusting the position of a plurality of valves in manifold 135. In some embodiments, the controller 115 automatically controls the fluid flow through the system once various setpoints or parameters are provided by an operator.

In various embodiments, controller 115 includes a display that incorporates a human-machine interface (HMI) and a light display of operating parameters, e.g., fluid pressure and volume. The control and set up of manifold 135 can be changed via a touch screen or manual switches. The HMI includes a user-input, which may include a keypad, voice-recognition apparatus, dial, switches, joystick, mouse, database and/or other conventional or future-developed data input device available to those of ordinary skill in the art. Such data input device may support data input from local and/or remote locations. In general, the data input means and/or other components within the scope of the present disclosure support operation and/or monitoring from one or more stations on the rig site, as well as one or more remote locations with a communications link to the system, network, local area network (LAN), wide area network (WAN), Internet, satellite-link, and/or radio, among other means.

The HMI may also include a display for visually presenting information to the operator in textual, graphical, audible, or video form, or any combination thereof. The display may also be utilized by the operator to input the data in conjunction with the data input device.

The HMI may be used by a human operator during drilling operations to monitor the relationship between different valves in the manifold 135. In an exemplary embodiment, the HMI is one of several display screens selectable by the user during drilling operations, and may be included as or within the human-machine interfaces, drilling operations and/or drilling apparatus.

The HMI is used by the operator while drilling to monitor positions of the valves (including any safety interlock information) in the manifold 135 and fluid pressure(s) near the top drive 105 and NSD sub 110. The controller 115 may store these values for future reference or transmit them to an external data system. The controller 115 can provide the operator with error messages when parameters are out of the ordinary range, or substantially different, i.e., having more than about 5-10% difference, from previously measured and stored values. In some embodiments, the HMI may include historical fluid pressure and valve position information, which can be compared to measured pressures and positions. If the measured pressures and/or positions are further than a preset (e.g., user adjustable or database-derived, or both) limit for a period longer than a preset duration, then the controller 115 may signal an audio and/or visual alarm. The operator may then be given the opportunity to allow continued automatic control, to take over manual operation, or to adjust one or more parameters and then to allow continued automatic operation if the pressures and/or positions promptly begin to return to within the permitted values or return within a limited preset time period.

The HMI and the controller 115 may be discrete components that are interconnected via wired or wireless means. Alternatively, the HMI interface and the controller 115 may be integral components of a single system.

The BOP stack 120 is designed to shut off the wellbore, prevent the escape of underground fluids, and prevent a blowout from occurring. The BOP stack 120 can be used to seal off the annulus between the drill string and the casing, and contains the returning mud under appropriate pressure control. BOP stacks typically include specialized valves that are used to seal, control, and monitor oil and gas wells. In the embodiment shown in FIG. 1, the drill string is routed through the BOP stack 120 toward the reservoir of oil and gas, and is located at the surface. Any suitable BOP device available that meets necessary safety and operating parameters may be used in connection with the present disclosure.

Mud pump 135 pressurizes fluid from a supply line, which may be conventionally connected to fluid flow outside of the wellbore, e.g., mud tank 125. Mud tank 25 holds fluid and allows particulates to settle. This may be achieved through conventional means, e.g., associated shakers, gas venting, and other separation equipment available to those of ordinary skill in the art. Pressurized fluid from mud pump 135 may be passed through manifold 135, which distributes pressurized fluid through hoses (e.g., which may be flexible in various embodiments) and standpipes to the NSD sub 110 and the top drive 105.

The manifold 135 includes a plurality of valves that can be actuated, for example, by a mechanical, hydraulic or electrical mechanism, or any combination thereof. In one embodiment, the manifold 135 allows quick rig tie in and can be fully integrated with a wide variety of standpipes. Preferably, in one embodiment, the valves are gate or wedge valves, or a combination thereof, and are electrically actuated. In one embodiment, manifold 135 includes four valves that are used to control the flow of mud through the NSD sub 110 and the top drive 105. The four valves direct the flow of mud and bleed pressure off the central bore and side bore of the NSD sub 110 depending on whether the top drive is in operation or not. In some embodiments, an interlock system controlled by the controller 115 prevents the valves from opening at the same time and prevents the valves from functioning during unsafe conditions.

The manifold 135 is typically self-contained and requires only a power source common on drilling rigs. The manifold 135 may be splittable or fully integrated into the rig's standpipe manifold. In one embodiment, the manifold 135 can be resized and reconfigured for electric actuators. The height of the manifold 135 may be reduced because of the smaller-sized actuators, and the manifold 135 can be split so that only power and control cables will be required instead of hydraulic and control lines. In such embodiments, the manifold 135 and controller 115 are wirelessly or wired coupled to the NSD sub 110 to control the flow of drilling fluids without requiring actual connections to any fluid lines or valves. The controller 115 can then control the first and second valve members in the NSD sub 110 directly. This can advantageously allow for a robust and compact design of the manifold 135 and eliminates any safety issues of removing and reconnecting pipes or hoses that are often required by managed pressure drilling when a separate component needs to be inserted in-line to control fluid flow in the system.

Figure 2:
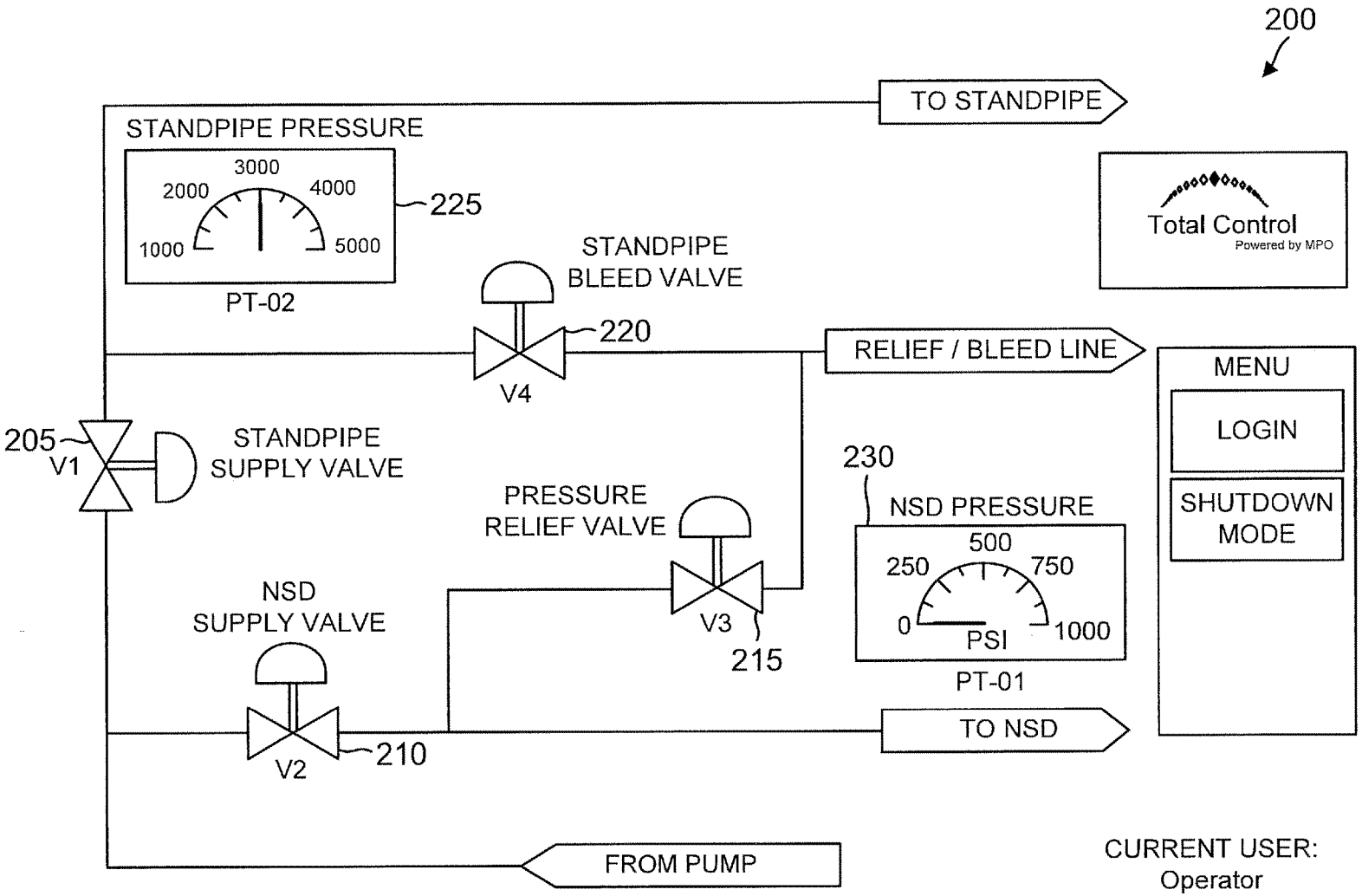
FIG. 2 is a screen shot showing a plurality of valves in a manifold according to one or more aspects of the present disclosure.

Referring now to FIG. 2, shown is a sample screen shot 200 of an HMI that may be displayed to an operator during drilling operations. The screen shot illustrates four valves 205, 210, 215, and 220, and fluid pressures 225, 230 associated with the standpipe 140 and the NSD side entry valve. During the usual operational mode of the drill string, there exists a pressure in the central bore of the NSD sub 110 that keeps the side entry valve of the NSD sub 110 closed. In one embodiment, the main valve in the central bore (e.g., a ball valve) is a manual valve that is opened and closed by an operator using a wrench. In operation, when valve 210 is open in the depicted embodiment, pressurized fluid is supplied to the side bore of the NSD sub 110. The main ball valve in the sub 110 is then closed, which allows the pressure in the side entry valve to overcome the pressure in the central bore. Once the applied pressure is sufficient to overcome the pressure in the central bore, the side entry valve opens and fluid passes through the side bore into the central bore of the NSD sub 110. Valve 205 is then closed, which shuts off fluid flow to top drive 105 and the main valve in the central bore to permit tubular connect or disconnect operations. Valve 220 is opened as needed to bleed fluid pressure off the central bore, standpipe, and the top drive 105, and then closed. When valve 205 is opened after the tubular operation(s) are complete, pressurized fluid is supplied to the top drive 105, the main valve in the central bore, and through the central bore of the NSD sub 110. The main ball valve in the NSD sub 110 is then opened slowly and as the pressure equalizes in the central bore, the side entry valve is forced to close. Valve 210 is closed to stop fluid from flowing through the side bore, and valve 215 is opened as needed to relieve pressure from the side bore and piping of the NSD sub 110. Drilling operations using the top drive 105 can then continue.

In one embodiment, valve 210 is sized to match the actual flow to the NSD sub 110. In another embodiment, valve 215 is SIL rated, and not only acts to relieve pressure from the NSD sub 110 and piping, but also provides secondary pressure relief to remove fluid pressure inmud pump 130. High pressures can build up in the mud pump 130 during drilling, and valve 215 helps to maintain safety of the mud pump 130. For example, a maximum threshold pressure can be set for the mud pump 130, and if that pressure is reached, valve 215 automatically opens to release pressure. Thus, a single valve (valve 215) performs the functions of bleeding pressure off the NSD sub 110 and releasing pressure from mud pump 130. In the past, a separate mechanical pressure relief valve was used. Removing this mechanical pressure relief valve reduces piping and complexity. In various embodiments, the valves 205, 210, 215, and 220 are controlled by an interlock system to prevent the inadvertent opening of one or more of the valves during operation. The valves are in an "interlocked relationship," meaning that when one valve is open, the other valve cannot be simultaneously open, or cannot be closed until the other is opened, or both, to ensure a continuous, controlled flow of drilling fluid.

For example, when valve 205 is open, controller 115 operates to keep valve 210 closed, and vice versa. When valve 205 is open to permit drilling operations with fluid flow from the top drive 105, valve 220 is kept closed, and vice versa. When valve 210 is open to permit flow through the side bore of the NSD sub 110, valve 215 is closed, and vice versa. When valve 215 is open, valve 220 is closed, and vice versa. In this way, control of fluid flow through the top drive 105 and the NSD sub 110 is more finely controlled to ensure continuous flow of fluid as desired.

An actuator is operably associated with each valve, and positions each valve at one or more incremental positions between and including an open position and a closed position. Electrical actuators may be positioned at virtually any selected position between and including the open and closed positions because of the flexibility of the motors, and provide more precise control of valve position and timing than many manually-operated valves. In a preferred embodiment, electric gear operated actuators are used to function the valves 205, 210, 215, and 220. The controller 115 may control the electric actuators through the use of position sensors built into the electric actuators for the valves 205, 210, 215, and 220, or the actuators may be controlled by an internal controller built into the actuators, without the need for an external controller. Moreover, an algorithm can be applied by controller 115 to monitor the positions of the valves and make precise controls, instead of taking external measurements.

With electronic valve actuation, the valve openings can be precisely controlled, e.g., the movement of the valves can be controlled at about 5% or less the size of the opening.

Electric actuators eliminate the possibility of spilling or leaking control fluid or gas, and are not fluid temperature or composition dependent. Electric actuators are generally easier to control than pneumatic or hydraulic systems. Furthermore, an electric actuator can accurately monitor the position of the valve at any point between fully opened and fully closed, if required, and can vary the position of the valve anywhere between the open and closed positions.

A method of continuously circulating drilling fluid through a tubular string will now be described. The method can be used to break and make tool joint connections without interrupting the circulation of mud.

During drilling, mud pump 130 injects drilling fluid, such as mud, through the top drive 105, which is intermittently connected to a top or surface end of the drill string to rotate the string to advance or retract it. While the top drive 105 is connected, valve 205 is opened to allow mud to flow through the central bore of the NSD sub 110, and valves 210, 215, and 220 are closed. When a new tubular needs to be added to the drill string, the side bore of the NSD sub 110 is intercepted from the outside and connected to manifold 135. Valve 210 is opened slowly to allow system pressure to reach the side entry valve of the NSD sub 110, and to minimize pressure spikes downhole. Typically, hydraulically actuated valves were more difficult to control with respect to percentage of the valve opened or closed. Advantageously, electric actuators provide finer control of the position of valve 210, which leads to greater control of downhole pressure. The electric actuators can also provide feedback on positions and pressures at the valves, which can facilitate more precise estimation of pressures and better prediction of changes in pressure to better control drilling operations.

The main ball valve in the central bore of the NSD sub 110 is then closed, and as the pressure through the top drive 105 is shut off, fluid begins to flow through the side entry valve and downhole. The fluid flow through the top drive 105 is stopped by closing the main ball valve and closing valve 205 of manifold 135. The whole flow of drilling fluid through the drill string now comes only from the side bore through valve 210. At this point of the process, the pressure segregated upstream of the central bore of the NSD sub 110, e.g., at the top drive 105, can be released to atmospheric pressure by opening valve 220 of manifold 135 to release excess pressure. A new tubular with NSD sub can now be connected to (or disconnected from) the drill string under safe conditions. The new tubular is connected (or disconnected) to the drill string.

Once the connection is made, the mud flow through the top drive 105 is ready to be restored. Valve 205 is slowly opened to allow fluid pressure to build up above the main valve in the central bore. Like valve 210, use of electric actuators allows for greater control of the position of valve 205 and pressure, and minimizes pressure spikes downhole.

The main valve is opened, and as the pressure through the top drive 105 increases, fluid begins to flow through the central bore and downhole. As the pressure decreases in the side bore and increases in the central bore, the side entry valve closes. Once all flow is going down the central bore, valve 210 is closed. Valve 215 is then opened to relieve pressure off the side bore, and the external connection to the side bore can be disconnected. To remove a tubular, the process is reversed.

The method of the present disclosure can be remotely controlled, e.g., by computer assisted control with manual override. The controller 115 may use any combination of electric, electronic, hydraulic, pneumatic, or electro-hydraulic controls.

A programmable controller, e.g., controller 115, may be utilized to control and/or perform at least a portion of and preferably a substantial portion of the above described method. For example, the controller 115 may control the opening and closing of valves 205, 210, 215, and 220 and/or first and second valve members of the NSD sub 110. Besides controlling the operation of valves 205, 210, 215, and 220, the controller 115 may warn the operator if the valves are not operating properly. For instance, the controller 115 may monitor the positions of the valves and the pressures in the top drive 105 and the NSD sub 110. In some embodiments, the controller 115 may then compare theses measured values to previously stored values to detect if something is wrong. The operator may then verify the warning.

The manifold 135 can be controlled in two different methods that offer both a simplified and fully automatic configuration. In one method, the control of the valves 205, 210, 215, and 220 is by internal controls in the actuators. Thus, the position of the valves, and whether or not they are in the open or closed position, is determined by an actuator controller that is integral to the actuator. The valve movements are programmable to various setpoints without the need for an external PLC.

In various embodiments, control of the valves is through a remote controller that is distributed by a simple hand held switch panel and mechanical switch gauges. The interlocks are controlled by the valves' internal control system, and the timing of the opening of valves 205 and 210 is controlled using a time out function internal to the actuator. The pressure indication is on the manifold 135 with no remote readout.

The second method is fully automatic using controllers external to the actuators. For example, in one embodiment the controller is a discrete and stand alone PLC, while in another embodiment it is fully integrated into the rig PLC. Like the first method, control of the valves may be through a wireless or wired handheld controller operated remotely. A smart phone or tablet can be connected to the manifold 135 via a wireless transmitter to display and control the manifold 135. There is enhanced pressure drop control when switching between operating modes, and the statistics of the system are tracked. An enhanced user interface with diagnostics can be used, and the controller can be reduced in size.

In both methods, the controller is used to activate the actuator and control the direction, extent, and duration of its output. The controller can be programmed to move the actuator to a customized position and produce a wide range of actuator positions. In various embodiments, the controller can collect and monitor real-time positional data from the valves and compare them with a set of ideal parameters to determine if there is a failure or if maintenance is required. Any differences between the two can drive the actuator to correct the disparity or activate an alarm of a potential issue.

The term "about," as used herein, should generally be understood to refer to both numbers in a range of numerals. Moreover, all numerical ranges herein should be understood to include each whole integer within the range.

The present disclosure relates to a method for continuously circulating drilling fluid through a tubular string. The method includes connecting a sub having a central bore and a side bore to the tubular string, connecting a top drive to the tubular string, connecting a manifold to the sub and top drive, and controlling the flow of drilling fluid through the sub and top drive by selectively opening and closing the electrically controlled valves. The manifold includes a plurality of electrically controlled valves.

The present disclosure further relates to another method for continuously circulating drilling fluid through a tubular string. The method includes connecting a sub containing a central bore and a side bore to the tubular string, connecting a top drive to the tubular string, connecting a manifold to the sub and top drive, and selectively opening and closing the electrically controlled gate valves. The manifold includes a plurality of electrically controlled gate valves in interlocked relationship and that are configured to control drilling fluid flow and pressure at the central bore and side bore.

Moreover, the present disclosure relates to a manifold for continuously circulating drilling fluid through a tubular string. The manifold includes a plurality of electrically controlled valves that control a flow of drilling fluid through a top drive and a sub having a central bore and a side bore, and a controller configured to monitor positions of the valves and fluid pressures at the central bore and side bore.

In addition, the present disclosure relates to a continuous drilling system that includes the manifold, a tubular string, and a sub having a central bore connected to the tubular string and a side bore connected to the manifold.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A method for continuously circulating drilling fluid through a tubular string, which method comprises:

connecting a sub having a central bore and a side bore to the tubular string;

connecting a top drive to the tubular string;

connecting a manifold to the sub and top drive, wherein the manifold comprises a plurality of electrically controlled valves, wherein the plurality of electrically controlled valves consist of a first valve configured to bleed pressure off the side bore, a second valve configured to control flow through the central bore, a third valve configured to control pressure through the side bore, and a fourth valve configured to bleed pressure off the central bore; and controlling the flow of drilling fluid through the sub and top drive by selectively opening and closing the electrically controlled valves.

2. The method of claim 1, wherein the plurality of electrically controlled valves comprise gate valves, wedge valves, or a combination thereof.

3. The method of claim 1, further comprising opening the second valve and closing the third valve to allow drilling fluid to enter the central bore and not the side bore, closing the second valve and opening the third valve to allow drilling fluid to enter the side bore and not the central bore, or both.

4. The method of claim 1, wherein the second and third valves are in an interlocked relationship, the second and fourth valves are in an interlocked relationship, the third and first valves are in an interlocked relationship, the fourth and first valves are in an interlocked relationship, or a combination thereof.

5. The method of claim 4, further comprising closing the second valve and opening the fourth valve, opening the second valve and closing the fourth valve, or both.

6. The method of claim 4, further comprising closing the third valve and opening the first valve, opening the third valve and closing the first valve, or both.

7. The method of claim 1, further comprising measuring a position of each of the valves, fluid pressure in the central bore, fluid pressure in the side bore, or a combination thereof.

8. The method of claim 7, further comprising displaying the valve position, fluid pressure, or both.

9. The method of claim 7, further comprising storing past valve position, fluid pressure, or both.

10. The method of claim 9, further comprising comparing measured valve positions and/or fluid pressures relative to a previously measured valve position and/or fluid pressure.

11. The method of claim 10, further comprising displaying a warning or sounding an alarm if the measured valve positions, fluid pressures, or both, are different from the past valve positions, fluid pressures, or both.

12. The method of claim 1, wherein the manifold is coupled to the sub without physical connections to fluid lines or valves of the sub.

13. A method for continuously circulating drilling fluid through a tubular string, which method comprises:

connecting a sub containing a central bore and a side bore to the tubular string;

connecting a top drive to the tubular string;

connecting a manifold to the sub and top drive, wherein the manifold comprises a plurality of electrically controlled gate valves in interlocked relationship and configured to control drilling fluid flow and pressure at the central bore and side bore, wherein the plurality of electrically controlled valves consist of a first valve configured to bleed pressure off the side bore, a second valve configured to control flow through the central bore, a third valve configured to control pressure through the side bore, and a fourth valve configured to bleed pressure off the central bore; and selectively opening and closing the electrically controlled gate valves.

14. The method of claim 13, wherein the second and third valves are in an interlocked relationship, the second and fourth valves are in an interlocked relationship, the third and first valves are in an interlocked relationship, the fourth and first valves are in an interlocked relationship, or a combination thereof.

15. The method of claim 13, further comprising monitoring a position of each of the valves and/or fluid pressures in the central and side bores.

16. The method of claim 15, wherein the monitoring comprises comparing measured valve positions and/or fluid pressures relative to a previously measured valve position and/or fluid pressure.

17. The method of claim 16, further comprising displaying a warning or sounding an alarm if the measured valve positions fluid pressures, or both, are different from the past valve positions, fluid pressures, or both.

18. The method of claim 13, further comprising displaying the valve positions and/or fluid pressures.

19. The method of claim 13, wherein the manifold is coupled to the sub without physical connections to fluid lines or valves of the sub.

20. A manifold for continuously circulating drilling fluid through a tubular string, which comprises:

a plurality of valves that consist of a first valve configured to bleed pressure off a side bore of a sub, a second valve configured to control flow through a central bore of a sub, a third valve configured to control pressure through the side bore, and a fourth valve configured to bleed pressure off the central bore, wherein the plurality of valves control a flow of drilling fluid through a top drive and the sub; and a controller configured to monitor positions of the valves and fluid pressures at the central bore and side bore.

21. The manifold of claim 20, wherein the plurality of valves comprise gate valves, wedge valves, or a combination thereof.

22. The manifold of claim 20, further comprising an interlock system configured to ensure that the second and third valves, the second and fourth valves, the third and first valves, the fourth and first valves, or a combination thereof, are not open simultaneously.

23. The manifold of claim 20, wherein the controller measures the valve positions and/or fluid pressures and compares the measured valve positions and/or fluid pressures relative to a previously measured valve position and/or fluid pressure.

24. The manifold of claim 23, wherein the controller displays a warning or sounds an alarm if the measured valve positions, fluid pressures, or both are different from the past positions, pressures, or both.

25. The manifold of claim 20, wherein the controller comprises a human-machine interface (HMI).

26. The manifold of claim 25, wherein the HMI comprises a touch screen interface.

27. The manifold of claim 25, wherein the HMI displays valve position and valve safety interlock information.

28. The manifold of claim 20, wherein the controller is integrated into a rig programmable logic controller (PLC) or integrated into an electric actuator.

29. A continuous drilling system comprising:

the manifold of claim 20;

a tubular string; and a sub having a central bore connected to the tubular string and a side bore connected to the manifold.

30. The continuous drilling system of claim 29, wherein the manifold is coupled to the sub without physical connections to fluid lines or valves of the sub.

31. The manifold of claim 20, wherein the a plurality of valves are electrically controlled.

* * * * *